US005357733A

United States Patent [19]

Weikert

[11] Patent Number: 5,357,733

[45] Date of Patent: Oct. 25, 1994

[54] ASEPTIC PACKAGING APPARATUS AND METHOD INCLUDING A CONTROL SYSTEM FOR ACCURATELY DISPENSING MATERIAL

[76] Inventor: Roy J. Weikert, 645 S. High St., Covington, Ohio 45318

[21] Appl. No.: 23,887

[22] Filed: Feb. 26, 1993

[51] Int. Cl.[5] ..... B65B 3/02; B65B 3/30; B65B 9/08

[52] U.S. Cl. ..... 53/455; 53/55; 53/64; 53/503; 53/562; 141/10; 141/317

[58] Field of Search ..... 53/455, 562, 55, 503, 53/64, 77; 141/10, 114, 317

[56] References Cited

U.S. PATENT DOCUMENTS

| | | | |
|---|---|---|---|
| 3,667,188 | 6/1972 | Benner, Jr. et al. | 53/455 X |
| 3,813,845 | 6/1974 | Weikert | 53/37 |
| 3,941,306 | 3/1976 | Weikert | 229/53 |
| 4,021,283 | 5/1977 | Weikert | 156/244 |
| 4,171,604 | 10/1979 | Weikert | 53/426 |
| 4,231,832 | 11/1980 | Weikert | 156/244.14 |
| 4,265,279 | 5/1981 | Weikert | 141/10 |
| 4,436,567 | 3/1984 | Weikert | 156/158 |
| 4,809,485 | 3/1989 | Neilsen | 53/503 |
| 4,893,453 | 1/1990 | Weikert | 53/469 |
| 4,958,665 | 9/1990 | Iwano | 53/503 X |
| 5,014,493 | 5/1991 | West | 53/503 X |
| 5,241,800 | 9/1993 | Steinke et al. | 53/503 X |

*Primary Examiner*—James F. Coan
*Attorney, Agent, or Firm*—Biebel & French

[57] ABSTRACT

An apparatus and method is disclosed for filling successive pouches which are interconnected in a continuous web by a tubular top portion. Material is dispensed into the pouches by an elongated filling pipe and a mass flow meter monitors the amount of material dispensed through the filling pipe. The rate at which the web is conveyed along the filling pipe is controlled in response to the measured mass flow of the material whereby the amount of material dispensed into each pouch is accurately controlled.

26 Claims, 5 Drawing Sheets

ASEPTIC PACKAGING APPARATUS AND METHOD INCLUDING A CONTROL SYSTEM FOR ACCURATELY DISPENSING MATERIAL

BACKGROUND OF THE INVENTION

This invention relates to an apparatus and method for dispensing a fluent material to pouches and, more particularly, to a method and apparatus for continuously filling successive pouches with an accurately measured mass of material whereby filled pouches are produced having a minimum amount of variation in weight.

The present invention further relates to filling and sealing a series of pouches or bags formed of plastic or other material, such as plastic foil laminates, on a continuous basis, and it has particular relation to machines and methods of the type shown in U.S. Pat. Nos. 3,813,845, 4,021,283, 4,171,604 and 4,893,453, which patents are co-owned by Weikert.

In the apparatus disclosed in the above-noted patents, a tube of material is first divided into a series of contiguous bags or pouches sealed from each other along their adjacent sides but interconnected through a continuous tubular portion which initially forms a common top for all of the bags or pouches. The tubular portion of this web is drawn along an elongated filling pipe having discharge ports at one end from which material is poured into each successive bag, with this processing line being tilted upwardly so that excess material in one bag will spill over into the adjacent following bag. After each bag is filled, it is sealed across the top and severed from the tubular portion as a separate, filled and sealed package. One problem associated with this filling system results from residual product coating the inner upper sides of the pouches as product flows from one pouch to a following pouch, which can interfere with a proper seal being formed at the top of the pouches.

While the apparatus and methods disclosed in the above-noted patents have proven successful for their intended purpose of successively filling pouches under aseptic conditions, the prior art apparatus and methods rely largely upon the physical characteristics of the pouches being filled and/or controlled opening and closing of dispensing ports, as well as the speed of the pouches as they are conveyed along the filling pipe, in order to ensure that a consistent mass or weight of material is packaged within each of the pouches. For example, the apparatus disclosed in U.S. Pat. No. 4,893,453 includes a shuttle plate to control filling through two apertures. The shuttle plate is actuated by an air cylinder operating under control of an electrosolenoid, and actuation occurs in response to a photocell sensor sensing the separation between pouches. However, the pouches are flexible such that a certain amount of deviation occurs in the sensed spacing between pouches, and operation of the shuttle plate based solely on the sensing of the pouches has therefore resulted in variations in the uniformity of the pouch content weight.

Consequently, there is a need for a packaging apparatus and method whereby a fluent material may be aseptically packaged in successive pouches and wherein there is very little variation in the mass or weight from pouch to pouch.

SUMMARY OF THE INVENTION

The present invention provides an apparatus and method for continuously packaging a material in successive pouches which are interconnected in a continuous web by a tubular top portion. The operations of the apparatus and method are directly related to the delivery of the material such that as the mass of the material delivered for filling the pouches varies, each of the other operations relating to the filling of the pouches will also vary in response thereto.

In one aspect of the invention, an apparatus is provided for filling successive pouches which are interconnected in a continuous web by a tubular top portion and which are separated from each other by a plurality of transverse seams extending from the tubular portion to a bottom edge of the continuous web, the apparatus comprising: an elongated filling pipe proportioned for insertion in the tubular portion of the web and having an inlet end and a discharge end, a material supply and a mass flow measuring device for delivering a measured quantity of material to the discharge end of the filling pipe and for producing an output signal corresponding to a measured mass of material passing to the inlet of the filling pipe, a conveyor for conveying the web in a predetermined direction along the pipe with the pouches depending therefrom to receive material from the discharge end, and a controller connected to the mass flow measuring device and the conveyor for controlling the rate at which the web is conveyed along the pipe in response to the output signal.

In another aspect of the invention, a fill area sensor is provided located adjacent to the discharge end of the pipe for sensing a perforation line or area between and parallel to transverse seams of adjacent pouches and for producing a signal in response to a sensed perforation area, and an infeed sensor is provided located in spaced relation to the discharge end of the product pipe or tube for sensing a perforation area between transverse seams of adjacent pouches. The controller monitors signals from the fill area sensor and the infeed sensor and maintains a predetermined interval between the signals whereby a predetermined slack in the web material is maintained prior to the web material reaching the discharge end of the pipe. The slack in the web material permits the pouches to expand with programmed micro-filtered gas pressure as they reach the discharge end of the product pipe in order to facilitate filling of the pouches with material.

In a further aspect of the invention, a method of packaging fluent material in successive pouches is provided, the method comprising the steps of: supplying a continuous web of pouches including a closed tube having upper and lower edges and spaced seam lines extending upwardly from the lower edge to a location spaced from the tube upper edge to form a series of pouches which are interconnected at the tops thereof by an integral tubular portion of the web and which are individually open to the tubular portion, conveying the web of pouches along an elongated filling pipe with the filling pipe received within the tubular portion, continuously supplying fluent material to be packaged to the pipe for discharge therefrom into the pouches, continuously monitoring the mass of the material supplied to the pipe, and controlling the rate at which the web of pouches is conveyed along the pipe in response to the monitored mass of material supplied to the pipe to ensure that a consistent quantity of material is discharged into each of the pouches.

In yet another aspect of the invention, a guide element is provided adjacent to the pipe to contact and separate an intermediate portion of adjacent pouches in order to facilitate sensing of the pouches as they are conveyed along the filling pipe.

It is therefore a primary object of the invention to provide an apparatus and method for accurately monitoring the position and rate of movement of successive pouches in relation to a filling pipe and for providing a precise mass of material to fill each of the pouches.

Other objects and advantages of the invention will be apparent from the following description, the accompanying drawings, and the appended claims.

DETAILED DESCRIPTION OF THE PREFERRED EMBODIMENT

Figure 1:
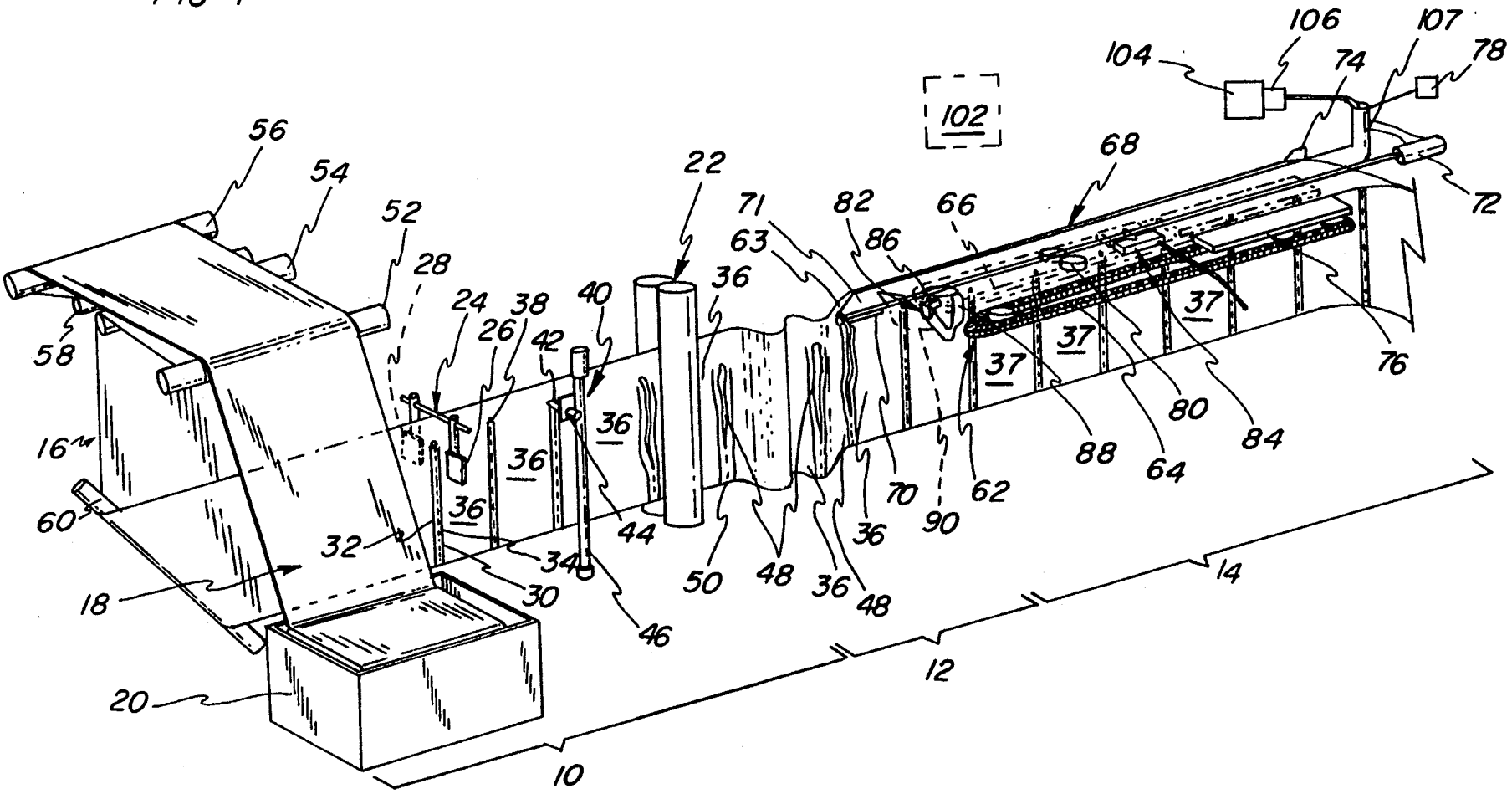
FIG. 1 is a perspective schematic view of the present invention.

The present invention provides an aseptic apparatus and method for accurately filling successive pouches interconnected in a continuous web with a specified controlled mass of material whereby each pouch is filled with the same quantity of material, Referring to FIG. 1, the present apparatus generally includes a feed area 10 for feeding the continuous web of material to the apparatus, a transition area 12 for preparing the material to be filled and a fill area 14 including an elongated filling pipe for dispensing material into the pouches, As will be evident from the description given below, an important aspect of the present apparatus and method relates to the accurate monitoring of the location of the pouches throughout the apparatus while also controlling the filling operation in response to a measured mass of material flowing into the fill pipe. This may be contrasted with prior art devices wherein the filling operation typically merely coordinates the operation of a pump for pumping the material to the filling pipe in combination with controlling of the conveying of the continuous web through the apparatus without providing an actual measurement of the mass pumped into the filling pipe and without coordinating the operation of the apparatus in response to this measured mass.

As shown in FIG. 1, the infeed area 10 includes a loader 16 which directs a continuous web of material 18 from a supply source 20. It should be noted that although the supply source 20 is shown as a box of the material, the material may also be fed from a roll or other conventional supply source. In addition, it should be noted that the web material 18 is preferably in the form of an aseptic tube of material having individual pouches defined therein and manufactured in accordance with a known process such as the one shown in U.S. Pat. No. 4,021,283, which is co-owned by Weikert and which is incorporated herein by reference.

As the web material 18 is fed through the loader 16 in the infeed area 10, the web material 18 is reoriented from a substantially horizontal position to a vertical position. A pair of nip rollers 22 draw the web material 18 through the loader 16 and out of the supply source 20 such that a certain minimum amount of tension is maintained in the web material 18 as it is drawn from the loader 16 through the nip rollers 22.

The infeed area 10 further includes an infeed sensor 24 located between the loader 16 and the nip rollers 22. The sensor 24 is of conventional construction and includes a light source element 26 and a collector element 28 which are vertically positioned to sense the location of a perforated area 30 located between adjacent transverse seams 32, 34 defining the edges of adjacent pouches 36. The pouch construction may be substantially the same as that shown in the above-referenced U.S. Pat. No. 4,021,283 to Weikert. It should be noted that alternative constructions for the perforated area 30 may be used. For example, an enlarged perforation hole 38 may be provided at the top of the perforation 30 in order to provide a large aperture for permitting passage of light through the web material 18 whereby sensing of the perforation location is facilitated.

A pouch separator or slitter 40 is also located within the infeed area between the infeed sensor 24 and the nip rollers 22. The slitter 40 includes a plunger 42 actuated by an air cylinder 44 which is mounted to a rodless cylinder 46 for vertical movement. In operation, the plunger 42 of the slitter 40 is actuated by the cylinder 44 to move forwardly toward the web material 18 and engage the perforations 30 between each of the pouches 36 at a location adjacent to the hole 38. With the plunger 42 thus engaged in the perforation area 30, the rodless cylinder 46 is actuated to pull the plunger 42 vertically downwardly to a location in spaced relation to a bottom edge 50 of the web material 18. In the preferred embodiment, the plunger 42 engages the web material 18 approximately 2 inches below the top edge thereof and moves downwardly to a location approximately 4 inches from the bottom edge thereof.

The slits formed between the pouches are designated generally as 48. The slits 48 are provided to facilitate opening of the pouches for filling in the filling area 14 as well as to facilitate the sensing of the location of the pouches 36 in the filling area 14, as will be described in further detail below.

It should be noted that it is important for the bottom edge 48 of the web material 18 to be formed as a continuous, unbroken area between the pouches 36 in order to ensure that the web material 18 is conveyed smoothly through the nip rollers 22 without the lower portions of the pouches 36 bunching or becoming misaligned as they enter the rollers 22. Further, it should be noted that it is contemplated that an alternative configuration for the web material 18 may be provided wherein the material between the seams on the pouches 36 is preslit, and including a lower perforated area adjacent to the bottom edge connecting adjacent pouches, such that the slitter 40 would not be necessary.

The loader 16 is configured to guide the web material 18 into the infeed area 10 such that the web material 18 is maintained at a constant vertical position, thereby ensuring that the vertical position of the web material 18 relative to the infeed sensor 24 and the slitter 40 is maintained constant such that the holes 38 and perforations 30 will be consistently sensed and slit without being affected by inaccuracies in the positioning of the web material 18.

Figure 4:
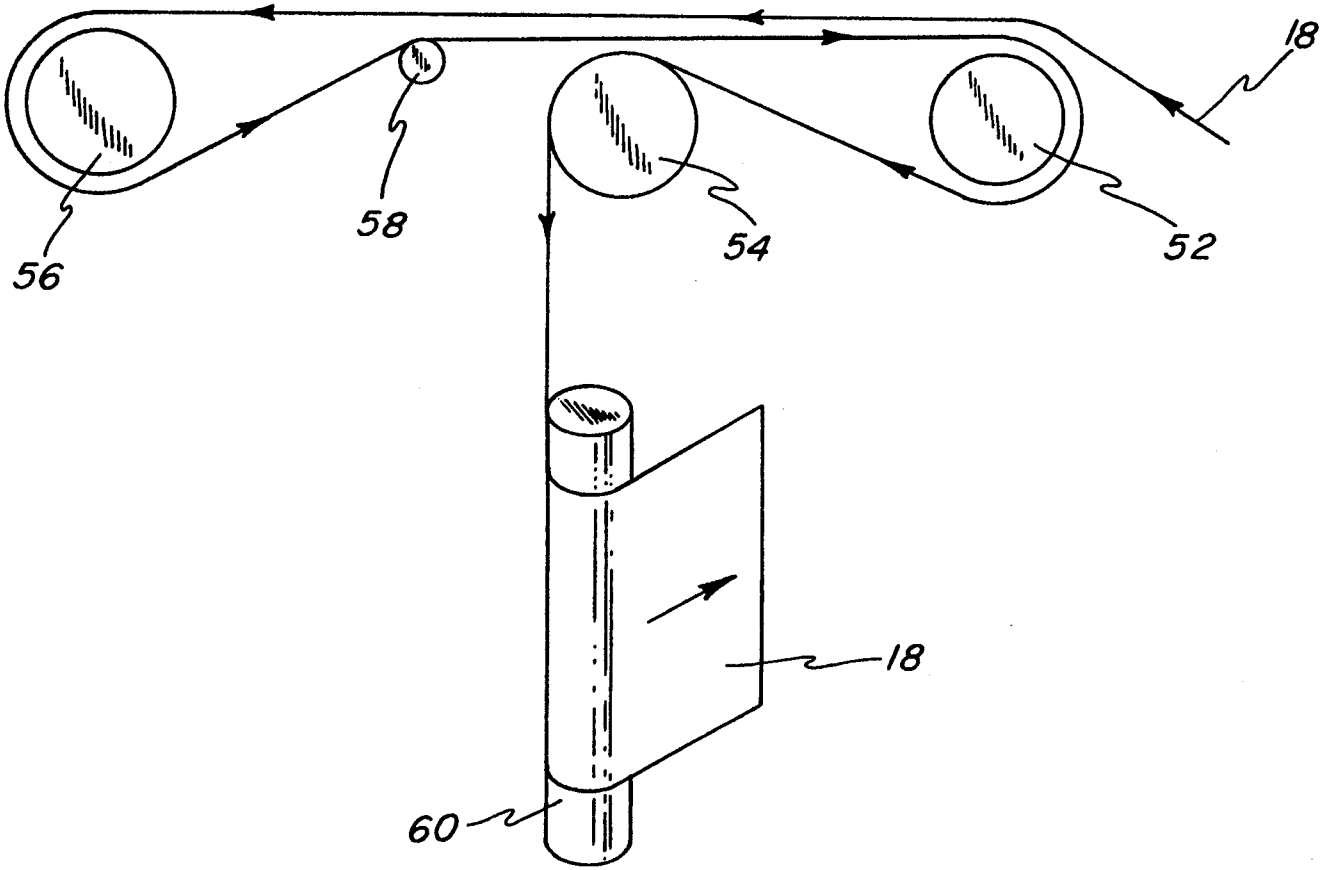
FIG. 4 is a schematic diagram illustrating the path followed by the web of continuous material as it passes through the loader.

Referring to FIGS. 1 and 4, it can be seen that the loader is constructed so as to cause the web material 18 to overlap and contact itself in multiple passes as it proceeds through the infeed area 10. Specifically, the loader 16 is provided with a series of upper mandrels including a first end mandrel 52, a middle mandrel 54, a second end mandrel 56 and an intermediate mandrel 58, all of which have a horizontally oriented longitudinal axis. In addition, an angled lower mandrel 60 is located below the middle mandrel 54 and is oriented at an angle of approximately 45° relative to the horizontal axis of the upper mandrels. As is best seen in FIG. 4, as it passes through the loader 16, the web material 18 passes over the first end mandrel 52, over the middle mandrel 54 around the second end mandrel 56, over the intermediate mandrel 58, between the first pass of the web material 18 and the middle mandrel 54, between the first pass of the web and the first end mandrel 52 and between the second pass of the web and the middle mandrel 54. The web material 18 then passes downwardly around the lower mandrel 60 and passes out of the loader 16 in a vertical orientation as shown in FIG. 1. It has been found that by passing the web material 18 in overlapping relationship in contact with itself, the natural tendency of the web to "walk" or move in a direction parallel to the longitudinal axis of the mandrels 52, 54, 56 and 58 is substantially eliminated such that, as the web passes downwardly toward the lower mandrel 60, it will be maintained at a substantially constant location resulting in the web material 18 coming off the mandrel 60 at a substantially constant vertical location. Thus, the vertical location of the web material 18 relative to the sensor 24 and the slitter 40 is predictable and consistent sensing and slitting of the area between the pouches 36 is assured.

Referring to FIG. 1, the fill area 14 of the apparatus is provided with a conveyor 62 which preferably consists of first and second gripper belts or chains 64, 66 forming a nip area therebetween for gripping the continuous web material 18 adjacent to the upper tubular portion 63 to thereby pull the web material 18 along a filler pipe 68.

The filler pipe 68 is of known construction and includes a shuttle valve 70 located on a lower side of a discharge end 71 for the pipe 68 and having longitudinally spaced first and second ports. The shuttle valve 70 is actuated by a cylinder 72 to alternately open the first and second ports whereby material within the filling pipe 68 will be dispensed into the pouches 36. In addition, a cutter or cutters 74 may be provided for removing the tubular upper portion 63 of the web material 18 from the completed sealed pouches as they leave a band sealer 76. The filling pipe structure 68 is substantially the same in structure and operation as the filling pipe disclosed in U.S. Pat. No. 4,893,453 which is co-owned by Weikert and which is incorporated herein by reference. This filling pipe design is selected for its capacity to package large particulate fluent materials, such as pie filling having fruit slices or pieces, with minimal damage to the particulates, which feature is particularly important to the food processing industries.

In addition, it should be mentioned that the shuttle valve 70, having a valving shuttle plate operating in combination with the two ports that it serves, is or may be structured such that it progressively closes one port as it opens the opposite port to consistently maintain the equivalent area of one port whereby the product pressure within the product delivery system is stabilized.

The filling pipe may be further provided with a source of microfiltered air or steam 78 which may be used in a conventional manner to provide sterilization as the web material 18 is initially fed onto the filling pipe 68 as well as for providing a pressurized air source to prevent non-sterile air from entering into the interior of the web material 18 during the filling operation. A pair of rollers 80 may also be provided for closing off the lower extremity of the upper tubular portion 63 whereby pressurized air within the tubular portion 63 will be retained between the pair of rollers 80 and the nip rollers 22.

The filling area 14 is further provided with a squeegee structure 82 located between the rollers 80 and the shuttle valve 70. The squeegee structure 82 includes a plurality of wipers 86, 88 and 90 located on opposing sides of the web material 18 for wiping any residual material from the upper sides of the filled pouches prior to reaching a fill area sensor 84 and the band sealer 76.

Figure 3:
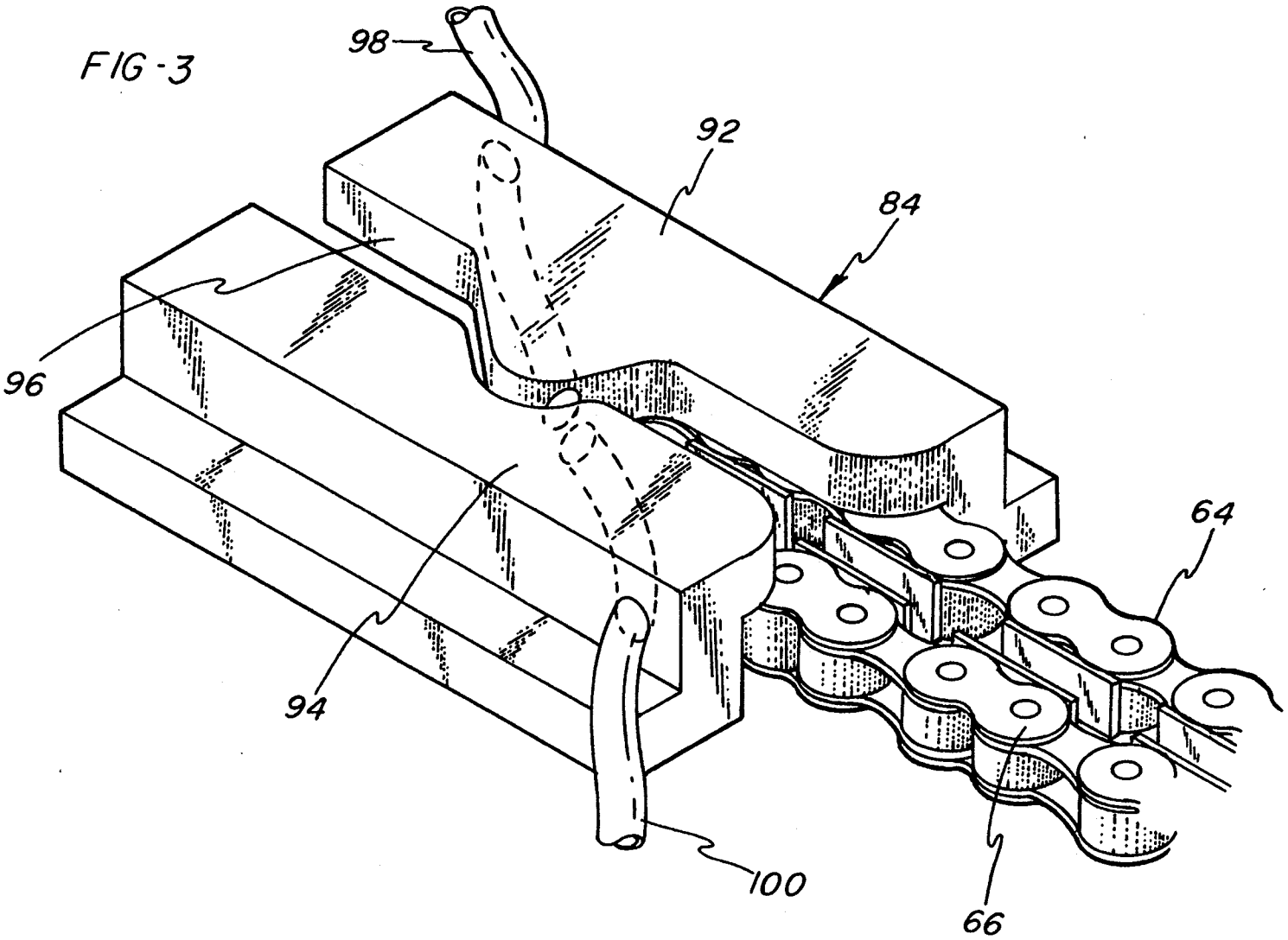
FIG. 3 is a perspective view of the guide path associated with the fill area sensor.

As may be seen in FIG. 1, the fill area sensor 84 is located in the fill area 14 between the rollers 80 and the band sealer 76. Referring further to FIG. 3, the fill area sensor 84 is provided with a unique construction for ensuring that a sufficiently large spacing is produced between each of the filled pouches 37 in order to provide for accurate sensing of the pouches. Specifically, the fill area sensor 84 is provided with first and second guide portions 92, 94 having surfaces for engaging and guiding the upper portion of the filled pouches adjacent to the slit 48 in a substantially S-shaped path 96. As the web material 18 follows the S-shaped path, the edges of the pouches defining the slit 48 are caused to separate from each other as a result of a bending force applied by the path 96 in a direction perpendicular to the direction of travel for the web material 18. Further, a light source 98 is provided embedded within the guide element 92 and opening at an apex of the path 96, and the guide portion 94 includes a collector 100 having an end opening opposite from the end of the light source 98 such that as a slit 48 passes between the light source 98 and the collector 100, a signal will be produced for transmission to a controller 102 (see FIG. 1).

Figure 2:
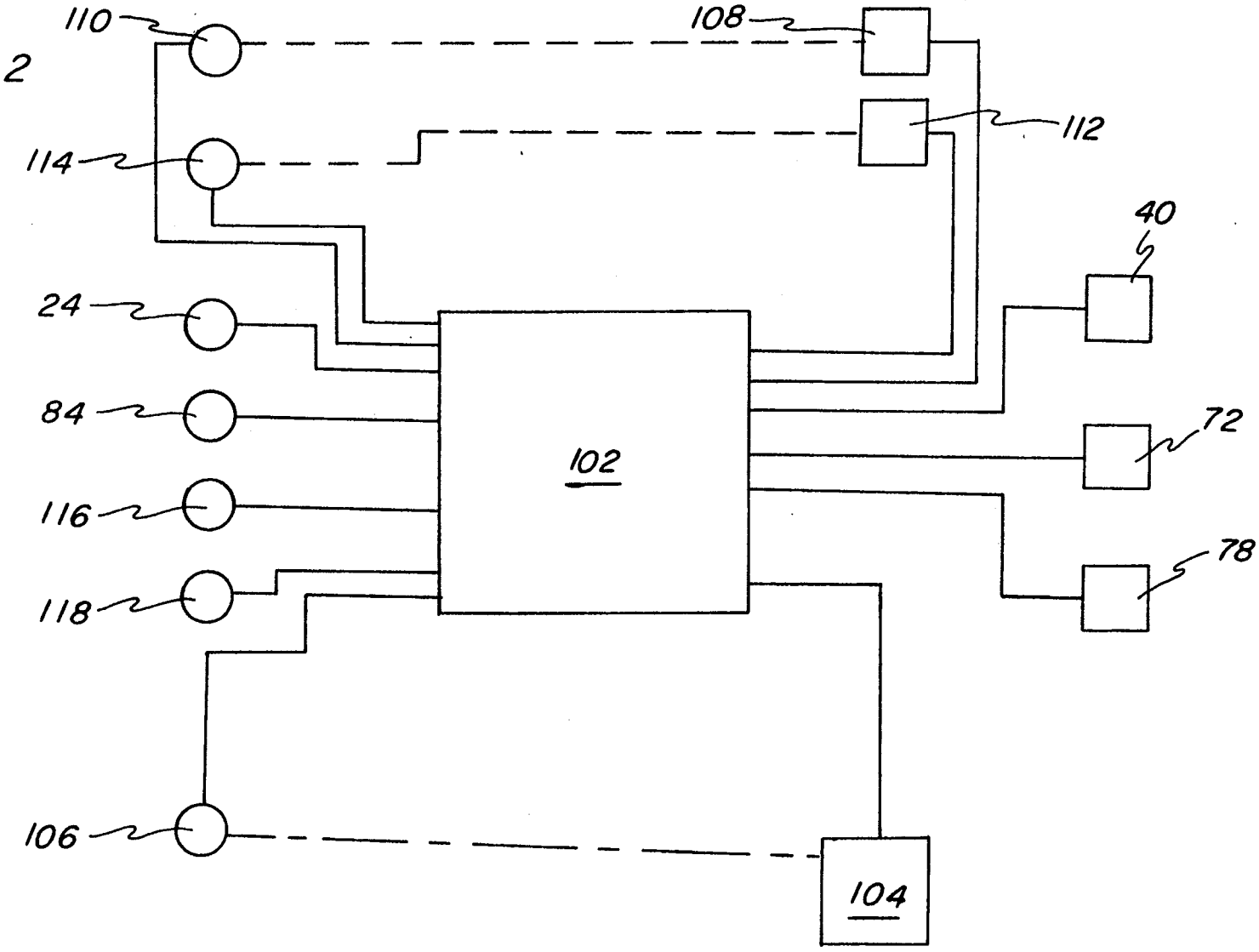
FIG. 2 is a schematic illustration showing components of the present invention for transmitting signals to and receiving signals from the controller.

As may be seen in FIGS. 1 and 2, the controller 102 is connected to a material supply 104 and mass flow meter 106 for supplying material to be dispensed to an inlet end 107 of the filling pipe 68. Further, the controller 102 controls the operation of each of the components of the apparatus wherein the operation of the entire apparatus is carried out with reference to an output signal received from the mass flow meter 106.

The various components which either send signals to the controller 102 or receive control signals from the controller 102 are illustrated in FIG. 2. The nip rollers 22 are powered by a nip roller motor 108 and the nip roller motor 108 is mechanically connected to an encoder 110, as depicted by a dotted line extending from the motor 108 to the encoder 110. The encoder 110 sends a signal to the controller 102 for monitoring the rotation of the nip rollers 22 whereby the amount of web material 18 being fed through the nip rollers 22 may be accurately monitored. Similarly, a conveyor motor 112 is provided for powering the conveyor chains 64, 66 and the motor 112 is mechanically connected to an encoder 114 for monitoring the travel of the conveyor 62. Thus, the controller 102 may accurately control the speed of the nip roller motor 108 and the conveyor motor 112 while also accurately monitoring the extent of travel of the web material 18 through the nip rollers 22 and the conveyor 62 with reference to the encoders 110, 114, respectively.

FIG. 2 also illustrates the connection of the infeed sensor 24 and the fill area sensor 84 with the controller 102, as well as the connection of the controller with the slitter 40 and with the cylinder 72 for controlling movement of the shuttle valve 70. In addition, it should be noted that inputs from thermocouples 116 and a pressure sensor 118 are also provided to the controller 102 for monitoring the temperature around the filling pipe 68 during a sterilization process for the apparatus, as well as for monitoring the pressure within the tubular upper portion 63 of the web material 18 during the filling operation. The controller 102 is also connected to the source 78 for steam and microfiltered air to control the supply of steam and air to the filling pipe 68 during the sterilization and filling processes, respectively.

Finally, it should be noted in FIGS. 1 and 2, that the mass flow meter 106 and material supply 104 are connected by a fluid connection depicted by the dot-dash line shown in FIG. 2 wherein material flowing from the material supply 104 passes through the mass flow meter 106 before proceeding to the filling pipe.

It should also be noted that the provision of a mass flow meter 106 is an important aspect of the present invention in that the present invention is specifically designed to provide a carefully measured mass of material to each pouch 36 whereby the filled pouches can be manufactured with a consistent final weight. The mass flow meter 106 used in the present invention is of conventional construction for handling various types of materials to be dispensed through the filling pipe 68 and is a Model 8300 Exac Mass Flow Transmitter manufactured by Exac Corp. of San Jose, Calif.

The method of filling the pouches 36 will now be described with reference to the apparatus described above. Initially, an operator will feed the web material 18 from the supply source 20 and thread it through the loader 16 and the nip rolls 22 to the filling pipe 68. Prior to performing the filling operation, a sterilization procedure must be performed to ensure that the interior of the hermetically sealed web material 18 remains in an aseptic condition. Such a sterilization procedure is well-known and is disclosed in U.S. Pat. No. 4,171,604 co-owned by Weikert, and incorporated herein by reference. For example, presterilization of the system may be effected by splicing a leading end of the web material 18 to a high temperature resistant film boot which is placed over the filling pipe 68. A metal cover jacket is placed over the boot in order to contain high pressure steam which is introduced within the boot. The steam is maintained within the boot for a predetermined amount of time and at a predetermined temperature in order to ensure complete sterilization of the filling pipe 68, which time and temperature is programmed into the controller 102.

The sterilization procedure will be monitored by the controller 102 which causes the source of steam 78 to provide steam to the filling pipe 68 for increasing the temperature inside and outside of the filling pipe as described in the above-referenced U.S. Pat. No. 4,171,604. In addition, the controller 102 will monitor the thermocouples 116 to ensure that the temperature is sufficiently high to provide an aseptic condition. After the aseptic condition of the filling pipe 68 is established, the source 78 will provide a supply of microfiltered air such that a slightly pressurized condition is maintained within the web material 18 to prevent any ambient air from flowing into the web material 18 and thus contaminating it. The compressed air supplied by the source 78 also causes the pouches at the discharge end 71 of the filling pipe 68 to expand outwardly and thereby facilitate flow of material from the shuttle valve 70 to the interior of the pouches 36 with contact between the material and the sides of the pouches at their opened end being minimized, if not totally avoided.

Prior to beginning the filling operation, the web material 18 within the transition area 12 is adjusted such that a predetermined amount of slack exists between the nip rollers 22 and the discharge end 71 of the filling pipe 68. This slack in the web material 18 ensures that the web material 18 is sufficiently untensioned or relaxed to permit expansion of the pouches 36 by the microfiltered compressed air prior to filling. The slit 48 formed in the upper portion of the web between each of the pouches 36 additionally permits expansion of the pouches 36 for receiving the material from the filling pipe 68.

once the predetermined amount of slack has been adjusted within the transition area 12, the controller 102 registers the delay or interval between a filled pouch 37 sensed by the fill area sensor 84 and a pouch 36 sensed by the infeed sensor 24. The controller 102 will maintain this interval between the two sensors 84 and 24 throughout the filling operation in order to maintain the predetermined slack in the transition area 12.

As the material 18 is drawn by the nip rollers 22 it is maintained in a tensioned state between the loader 16 and the rollers 22 and the sensor 24 will send a signal to the controller 102 for each pouch which passes through the infeed area. The controller 102 will cause the slitter 40 to slit the perforated area 30 at a predetermined interval subsequent to the pouch passing the infeed sensor 24 and the encoder 110 associated with the nip rollers 22 will provide the necessary signal to the controller 102 to determine the exact distance traveled by the web through the infeed area 10 in order to ensure precise slitting of the web material 18.

As the web material 18 is conveyed over the filling pipe 68, the pouches 36 are successively filled by the shuttle valve 70 which is controlled by the controller 102 in response to signals received from the fill area sensor 84 and the mass flow meter 106. Specifically, the shuttle valve 70 is moved to open the first port in an initial fill position, shown in FIG. 5A, at a predetermined interval after the sensor 84 senses a pouch passing through the fill area 14. The point at which the filling of a pouch is initiated is referred to as the pour point and the interval between the sensor 84 sensing a pouch and the shuttle valve 70 moving to its initial position is referred to as the shuttle valve offset. It should be noted that the shuttle valve offset is monitored with reference to the conveyor motor encoder 114 such that the shuttle valve offset corresponds to a predetermined distance moved by the web material 18 through the fill area 14 after the sensing of a pouch 37 by the fill area sensor 84.

Figure 5A:
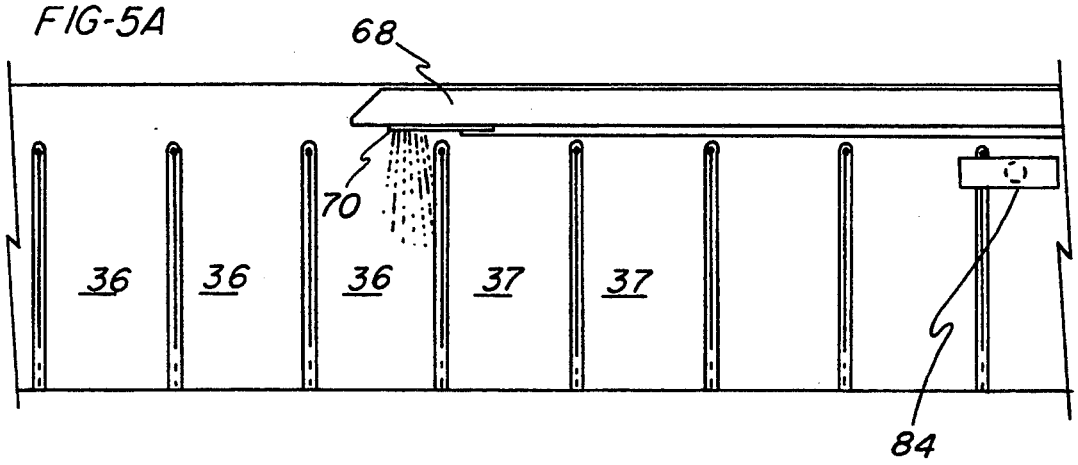
FIGS. 5A and 5B are schematic elevational views illustrating a filling sequence for a pouch.
Figure 5B:
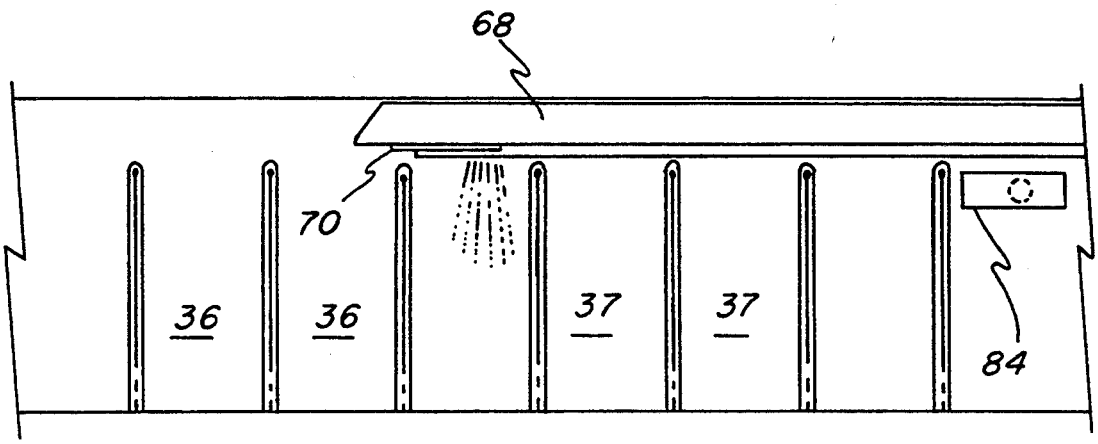

Once the shuttle valve 70 moves to the position shown in FIG. 5A, the mass flow meter 106 begins to measure a predetermined mass to be filled in the pouch 36, and when 50% of the predetermined quantity has been dispensed, the shuttle valve 70 will move to the position shown in FIG. 5B to open the second port. With the second port thus opened, the remainder of the predetermined quantity of material will be dispensed into the pouch 36. At the conclusion of the filling of the pouch, the shuttle valve 70 will again shift to its initial position and the time at which this shift occurs should correspond to the shuttle valve offset interval with reference to the pouch sensed by the sensor 84.

The controller 102 is continuously monitoring the material mass flow going into the filling pipe 68 and comparing it with the intervals between pouches, as measured by the fill area sensor 84, as well as the interval between pouches measured by the infeed area sensor 24. If there is any deviation between the pour point and the point at which the mass flow meter indicates that 100% of the material has been dispensed, the controller 102 will cause the conveyor 62 to either speed up or slow down to ensure that the material dispensing matches the conveyor speed and the location of the pouches within the fill area 14. In the same way, the controller 102 will control the nip roller motor 108 such that any variation in speed of the conveyor 62, as well as any variation in the predetermined interval between sensing the pouch at fill area sensor 84 and infeed sensor 24, will result in the speed and/or rotational position of the nip rollers 22 being altered to compensate for these changes whereby the predetermined slack in the transition area between the nip rollers 22 and the filling pipe 68 remains constant.

As noted above, an important aspect of the present invention resides in the fact that the operation of the present apparatus is controlled with reference to the measured mass of material flowing through the mass flow meter 106. Thus, any variations in the flow of material into the filling pipe 68 will be reflected in the controller 102 causing the speed of the conveyor 62 and speed of the nip rollers 22 to be varied such that the dwell time of the pouches underneath the shuttle valve 70 is accurately controlled to receive the full amount of material and the amount of slack in the transition area 12 is maintained at a constant predetermined amount.

It should also be noted that, although not shown in the drawings, the present apparatus is preferably provided with side conveyors running through the transition area 12 and the fill area 14 and a lower conveyor for supporting the bottom edge 50 of the web through the areas 12 and 14, which conveyors are conventional and well-known in the art.

Finally, it should be noted that predetermined recipes may be programmed into the controller 102 to provide preset constant parameters for performing a filling operation. Such preset parameters might include the temperature of the band sealer 76, the quantity of material to be filled in the pouches, the upper and lower limits of movement of the slitter 40 and an initial setting for the pour point which may be subsequently adjusted by an operator to optimize the filling operation.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. An apparatus for filling successive pouches which are interconnected in a continuous web by a tubular top portion and which are separated from each other by a plurality of transverse seams extending from the tubular portion to a bottom edge of the continuous web, said apparatus comprising:

an elongated filling pipe proportioned for insertion in said tubular portion of said web and having an inlet end and a discharge end, a material supply and a mass flow measuring device for delivering a measured quantity of material to said discharge end of said filling pipe and for producing an output signal corresponding to a measured mass of material passing to said inlet end of said filling pipe, a conveyor for conveying said web in a predetermined direction along said pipe with said pouches depending therefrom to receive material from said discharge end, and a controller connected to said mass flow measuring device and said conveyor for controlling the rate at which said web is conveyed along said pipe in response to said output signal.

2. The apparatus as in claim 1 wherein said discharge end defines a pair of outlet ports spaced longitudinally from each other along the underside of said filling pipe, and port actuating means connected to said controller for alternately opening and closing each of said ports in response said output signal such that a predetermined mass of material is accurately distributed to each pouch.

3. An apparatus for filling successive pouches which are interconnected in a continuous web by a tubular top portion and which are separated from each other by a plurality of transverse seams extending from the tubular portion to the bottom edge of the continuous web, said apparatus, comprising:

an elongated filling pipe proportioned for insertion in said tubular portion of said web and having an inlet end and a discharge end, a material supply and a mass flow measuring device for delivering a measured quantity of material to said discharge end of said filling pipe and for producing an output signal corresponding to a measured mass of material passing to said inlet end of said filling pipe, a conveyor for conveying said web in a predetermined direction along said pipe with said pouches depending therefrom to receive material from said discharge end, a controller connected to said mass flow measuring device and said conveyor for controlling the rate at which said web is conveyed alone said pipe in response to said output signal, and a fill area sensor adjacent said filling pipe for sensing the location of said pouches relative to said discharge end.

4. The apparatus as in claim 3 wherein a through slit is defined between said transverse seams of adjacent pouches and said fill area sensor includes opening means for causing said pouches to separate at said slit and thereby facilitate sensing the location of said pouches.

5. The apparatus as in claim 4 including a supply source of said continuous web and a slitter located between said supply source and said discharge end of said filler pipe for forming said through slit, said slitter forming said through slit at a location intermediate said tubular portion and said bottom edge.

6. The apparatus as in claim 4 wherein said opening means comprises a guide element for contacting side portions of said pouches and biasing said pouches sideways in a direction transverse to said predetermined direction.

7. An apparatus for filling successive pouches which are interconnected in a continuous web by a tubular top portion and which are separated from each other by a plurality of transverse seams extending from the tubular portion to the bottom edge of the continuous web, said apparatus comprising:

an elongated filling pipe proportioned for insertion in said tubular portion of said web and having an inlet end and a discharge end, a material supply and a mass flow measuring device for delivering a measured quantity of material to said discharge end of said filling pipe and for producing an output signal corresponding to a measured mass of material passing to said inlet end of said filling pipe;

a conveyor for conveying said web in a predetermined direction along said pipe with said pouches depending therefrom to receive material from said discharge end a controller connected to said mass flow measuring device and said conveyor for controlling the rate at which said web is conveyed along said pipe in response to said output signal;

said discharge end defining a pair of outlet ports spaced longitudinally from each other along the underside said filling pipe, port actuating means connected to said controller for alternately opening and closing each of said ports in response to said output signal such that a predetermined mass of material is accurately distributed to each pouch, and, a fill area sensor adjacent to said discharge end for sensing the location of a pouch wherein a first one of said ports opens to initiate a filling operation for a pouch in response to a signal from a fill area sensor indicating the location of a pouch relative to said outlet ports.

8. An apparatus for filling successive pouches which are interconnected in a continuous web by a tubular top portion and which are separated from each other by a plurality of transverse seams extending from the tubular portion to the bottom edge of the continuous web, said apparatus comprising:

an elongated filling pipe proportioned for insertion in said tubular portion of said web and having an inlet end and a discharge end, a material supply and a mass flow measuring device for delivering a measured quantity of material to said discharge end of said filling pipe and for producing an output signal corresponding to a measured mass of material passing to said inlet end of said filling pipe, a conveyor for conveying said web in a predetermined direction alone said pipe with said pouches depending therefrom to receive material from said discharge end, a controller connected to said mass flow measuring device and said conveyor for controlling the rate at which said web is conveyed along said pipe in response to said output signal, a supply source for said continuous web, and nip rollers located between said conveyor and said supply source, said nip rollers including a drive motor operating under control of said controller for powering said nip rollers to draw said web from said supply source and maintain a predetermined slack in said web between said nip rollers and said conveyor.

9. The apparatus as in claim 8 including an infeed sensor located between said supply source and said nip rollers and a fill area sensor located adjacent to said discharge end of said filling pipe, each of said sensors sensing an edge of a pouch, and said controller monitoring a delay between a first signal received from said fill area sensor and a second signal received from said infeed sensor and controlling the speed of said conveyor and said nip rollers to maintain said predetermined slack in said web by maintaining a predetermined delay between said first and second signals.

10. The apparatus as in claim 8 including an infeed sensor located between said supply source and said nip rollers and a loader located between said supply source and said infeed sensor for guiding said web to said nip rollers and maintaining said web at a substantially constant vertical position relative to said infeed sensor.

11. The apparatus as in claim 10 wherein said loader comprises a series of mandrels for directing said web in overlapping relationship in contact with itself to limit movement of said web in a direction parallel to longitudinal axes of said mandrels.

12. An apparatus for filling successive pouches which are interconnected in a continuous web by a bottom edge and by a tubular top portion, and which are separated from each other by a plurality of transverse seams interconnected at the tubular portion and extending from the tubular portion to the bottom edge of the continuous web, said apparatus comprising:

an elongated filling pipe proportioned for insertion in said tubular portion of said web and having an inlet end and a discharge end, a material supply for supplying a flow of fluent material to be packaged to said inlet end of said pipe, a conveyor adjacent to said pipe for conveying said web in a predetermined direction along said pipe with said pouches depending therefrom to receive material from said discharge end, a supply source for said web and drawing means located between said supply source and said conveyor for drawing said web from said supply source, a fill area sensor located adjacent to said discharge end for sensing a perforation area between said transverse seams of adjacent pouches and for producing a signal in response to a sensed perforation area, an infeed sensor located adjacent to said drawing means for sensing a perforation area between said transverse seams of adjacent pouches and for producing a signal in response to a sensed perforation area, and a controller for receiving said signals from said fill area sensor and said infeed sensor, said controller controlling the speed of said conveyor and said drawing means to maintain a predetermined interval between the signal from said fill area sensor and the signal from said infeed sensor.

13. The apparatus as in claim 12 wherein said material supply comprises a mass flow measuring device connected to said controller and said controller controls the speed of said conveyor in response to a mass flow measurement output from said mass flow measuring device to ensure that a consistent mass of material is delivered to each pouch.

14. The apparatus as in claim 13 wherein said discharge end defines a pair of outlet ports spaced longitudinally from each other along the underside of said filling pipe, and port actuating means connected to said controller for alternately opening and closing each of said ports for each pouch in response said mass flow measurement output such that a predetermined mass of material is accurately distributed to each pouch.

15. The apparatus as in claim 12 including a source of gas for expanding pouches adjacent to said discharge end to thereby facilitate distribution of material into said pouches.

16. The apparatus as in claim 12 wherein said perforation area sensed by said fill area sensor comprises an elongated slit located between said tubular portion and said bottom edge, and including a guide for causing said slit to open adjacent to said fill area sensor.

17. An apparatus for filling successive pouches which are interconnected in a continuous web by a bottom edge and by a tubular top portion, and which are separated from each other by a plurality of transverse seams extending from the tubular portion to the bottom edge of the continuous web, said apparatus comprising:

an elongated filling pipe proportioned for insertion in said tubular portion of said web and having an inlet end and a discharge end, a material supply and a mass flow measuring device for continuously delivering a measured quantity of fluent material to said discharge end of said filling pipe and for producing an output signal corresponding to a measured mass of material passing to said inlet end of said filling pipe, a conveyor adjacent to said pipe for engaging said web adjacent to an upper end of said pouches, said conveyor continuously conveying said web in a predetermined direction along said pipe with said pouches depending therefrom to receive material from said discharge end, a supply source for said web and nip rollers located between said supply source and said conveyor for drawing said web from said supply source, a fill area sensor located adjacent to said discharge end for sensing a perforation area between said transverse seams of adjacent pouches and for producing a signal in response to a sensed perforation area, an infeed sensor located adjacent to said nip rollers for sensing a perforation area between said transverse seams of adjacent pouches and for producing a signal in response to a sensed perforation area, a loader located between said supply source and said nip rollers for producing a tension in said web whereby said web is maintained at a substantially constant vertical position relative to said infeed sensor, and a controller for receiving said signals from said mass flow measuring device, said fill area sensor and said infeed sensor, said controller controlling the speed at which said web is conveyed along said pipe in response to said output signal, said controller further controlling the speed of said conveyor and said nip rollers to maintain a predetermined interval between the signal from said fill area sensor and the signal from said infeed sensor.

18. The apparatus as in claim 17 wherein said fill area sensor includes a guide defining an S-shaped path for engaging an upper end of said pouches and causing said perforation area to open and thereby facilitate sensing of the location of pouches by said fill area sensor.

19. The apparatus as in claim 17 wherein said discharge end defines a pair of outlet ports spaced longitudinally from each other along the underside of said filling pipe, and port actuating means connected to said controller for alternately opening and closing each of said ports for each pouch such that a predetermined mass of material is accurately distributed to each pouch.

20. A method of packaging fluent material in successive pouches, said method comprising the steps of:

supplying a continuous web formed as a closed tube having upper and lower edges and including spaced seam lines extending upwardly from said lower edge to a location spaced from said tube upper edge to form a series of pouches which are interconnected at the tops thereof by an integral tubular portion of said web and which are individually open to said tubular portion, conveying said web of pouches along an elongated filling pipe with said filling pipe received within said tubular portion, continuously supplying fluent material to be packaged to said pipe for discharge therefrom into said pouches, continuously monitoring the mass flow of said material supplied to said pipe, and controlling the rate at which said web of pouches is conveyed along said pipe in response to the monitored mass of material supplied to said pipe to ensure that a consistent quantity of material is discharged into each of said pouches.

21. The method as in claim 20 including the step of alternately opening and closing a pair of longitudinally spaced ports on a discharge end of said pipe for discharging said material into each pouch.

22. The method as in claim 20 including the step of containing said material in each of said pouches by sealing said tube along a line intersecting said seam lines adjacent the upper ends thereof.

23. A method of packaging fluent material in successive pouches, said method comprising the steps of:

supplying a continuous web formed as a closed tube having upper and lower edges and including spaced seam lines extending upwardly from said lower edge to a location spaced from said tube upper edge to form a series of pouches which are interconnected at the tops thereof by an integral tubular portion of said web and which are individually open to to said tubular portion, conveying said web of pouches along an elongated filling pipe with said filling pipe received within said tubular portion, continuously supplying fluent material to be packaged to said pipe for discharge therefrom into said pouches, continuously monitoring the mass of said material supplied to said pipe, controlling the rate at which said web of pouches is conveyed along said pipe in response to the monitored mass of material supplied to said pipe to ensure that a consistent quantity of material is discharged into each of said pouches, maintaining a predetermined amount of slack in said web prior to said web reaching said pipe, and expanding said pouches adjacent to said pipe to facilitate discharge of said material into said pouches.

24. The method as in claim 23 wherein said step of maintaining a predetermined amount of slack in said web comprises sensing the location of a first pouch adjacent to said pipe and sensing the location of a second pouch in spaced relation to said pipe and maintaining a predetermined interval between the sensing of said first pouch and the sensing of said second pouch.

25. The method as in claim 24 wherein said step of sensing said first pouch comprises providing a guide element to separate an intermediate portion of adjacent pouches to facilitate said sensing.

26. A method of packaging fluent material in successive pouches, said method comprising the steps of:

supplying a continuous web formed as a closed tube having upper and lower edges and including spaced seam lines extending upwardly from said lower edge to a location spaced from said tube upper edge to form a series of pouches which are interconnected at the tops thereof by an integral tubular portion of said web and which are individually to said tubular portion, conveying said web of pouches along an elongated filling pipe with said filling pipe received within said tubular portion, continuously supplying fluent material to be packaged to said pipe for discharge therefrom into said pouches, continuously monitoring the mass of said material supplied to said pipe, and controlling the rate at which said web of pouches is conveyed along said pipe in response to the monitored mass of material supplied to said pipe to ensure that a consistent quantity of material is discharged into each of said pouches, said upper and lower edges of said pouches being interconnected and an elongate through slit being defined between adjacent pouches and intermediate said upper and lower edges prior to conveying said web of pouches along said pipe.

* * * * *

UNITED STATES PATENT AND TRADEMARK OFFICE

CERTIFICATE OF CORRECTION

PATENT NO. : 5,357,733

DATED : October 25, 1994

INVENTOR(S) : Roy J. Weikert

It is certified that error appears in the above-indentified patent and that said Letters Patent is hereby corrected as shown below:

Column 10, line 41, "alone" should be --along--.

Column 11, line 20, after "underside", insert --of--.

Column 11, line 48, "alone" should be --along--.

Signed and Sealed this

Thirty-first Day of January, 1995

*Attest:*

Bruce Lehman

BRUCE LEHMAN

*Attesting Officer*

*Commissioner of Patents and Trademarks*